US006910831B2

(12) United States Patent
Raines

(10) Patent No.: US 6,910,831 B2
(45) Date of Patent: Jun. 28, 2005

(54) METHOD FOR INSTALLING A PILE ANCHOR

(75) Inventor: Richard D. Raines, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 10/382,291

(22) Filed: Mar. 5, 2003

(65) Prior Publication Data

US 2003/0167659 A1 Sep. 11, 2003

Related U.S. Application Data

(60) Provisional application No. 60/362,875, filed on Mar. 8, 2002.

(51) Int. Cl.[7] ..... E02D 15/08; E02D 5/22

(52) U.S. Cl. ..... 405/224.1; 405/224.2

(58) Field of Search ..... 405/224.2, 203, 405/223.1, 224, 224.1

(56) References Cited

U.S. PATENT DOCUMENTS

| | | | | |
|---|---|---|---|---|
| 3,852,969 A | | 12/1974 | Gibson et al. | |
| 4,131,166 A | * | 12/1978 | Schnell | 405/232 |
| 4,185,694 A | | 1/1980 | Horton | |
| 4,690,586 A | | 9/1987 | Oksuzler | |
| 4,702,047 A | * | 10/1987 | Stokes | 114/295 |
| 5,033,908 A | * | 7/1991 | Auraen | 405/204 |
| 5,127,767 A | | 7/1992 | Plagborg-Moller | |
| 6,122,847 A | | 9/2000 | Treu et al. | 37/345 |
| 6,457,908 B1 | * | 10/2002 | Bergeron | 405/224 |

FOREIGN PATENT DOCUMENTS

| | | |
|---|---|---|
| GB | 1269599 | 4/1972 |
| WO | WO 99/25606 | 5/1999 |

OTHER PUBLICATIONS

Dahlberg, R.; Strom P. J., "Design Procedures for Deepwater Fluke Anchors, Drag–In Plate Anchors", Offshore, vol. 60, No. 4, Apr. 2000, pp. 101–102, 104, 224.

Handayanu, Swamidas, A. S. J., Booton, M. "Behaviour of Tension Foundation for Offshore Structures under Extreme Pull–Out Loads", OMAE99, 18$^{th}$ International Conference on Offshore Mechanics and Arctic Engineering, Jul. 11–16, 1999, St. Johns NF Canada, pp. 635–641.

Allersma, H. G. B. et al., "Centrifuge and Numerical Modelling of Methods to Optimize the Horizontal Bearing Capacity of Suction Piles", OMAE99, 18$^{th}$ International Conference on Offshore Mechanics and Arctic Engineering, Jul. 11–16, 1999, St. Johns NF Canada, pp. 643–651.

El–Gharbawy, S., "Suction Caissons in Soft Clay", OMAE99, 18$^{th}$ International Conference on Offshore Mechanics and Arctic Engineering, Jul. 11–16, 1999, St. Johns NF Canada, pp. 627–633.

Lo, K. Y. et al., "Electrokinetic Strengthening of Soft Marine Clays", 9$^{th}$ International Offshore and Polar Engineering Conference, Brest, France, May 30–Jun. 4, 1999, pp. 590–595.

House, A. R. et al., "Limiting Aspect Ratio for Suction Caisson Installation in Clay", 9$^{th}$ International Offshore and Polar Engineering Conference, Brest, France, May 30–Jun. 4, 1999, pp. 676–683.

(Continued)

*Primary Examiner*—Michael Safavi
(74) *Attorney, Agent, or Firm*—Phillip Woo; Douglas Collins

(57) ABSTRACT

A method for installing a pile anchor into the sea floor that enhances the holding capacity of the pile anchor. The pile anchor is installed at an inclined angle with respect to the sea floor, with the top of the anchor inclined in a direction opposite the lateral load applied to the anchor.

27 Claims, 6 Drawing Sheets

OTHER PUBLICATIONS

El–Gharbawy, S., Olsen, R., "The Cyclic Pullout Capacity of Suction Caisson Foundations", 9th International Offshore and Polar Engineering Conference, Brest, France, May 30–Jun. 4, 1999, pp. 660–667.

El–Gharbawy, S., "The Application of Suction Caissons for Deepwater Mooring Offshore West Africa", 3rd Annual Pennwell Offshore West Africa Conference, Abidjan, Cote D'Ivoire, Mar. 23–25, 1999, pp. 1–10.

El–Gharbawy, S. et al., "Suction Anchor Installations for Deep Gulf of Mexico Applications", OTC 10992, 31st Annual Offshore Technology Conference, Houston, Texas, May 3–6, 1999, vol. 1, pp. 747–754.

Byrne, B. W., Houlsby, G. T., "Drained Behavior of Suction Caisson Foundations on Very Dense Sand", OTC 10994, 31st Annual Offshore Technology Conference, Houston, Texas, May 3–6, 1999, vol. 1, pp. 765–782.

Ercrich, C. T., Tjelta, T. I., "Installation of Bucket Foundations and Suction Caissons in Sand—Geotechnical Performance", OTC 10990, 31st Annual Offshore Technology Conference, Houston, Texas, May 3–6, 1999, vol. 1, pp. 725–735.

Sparrevik, P. "Suction Anchors—A Versatile Foundation Concept Finding its Place in the Offshore Market", OMAE 98–3096, 17th International Conference on Offshore Mechanics and Arctic Engineering, Lisbon, Portugal, Jul. 5–9, 1998, 12 pages.

Jeanjean, P. et al., "Soil Parameters for Design of Suction Caissons for Gulf of Mexico Deepwater Clays", OTC 8830, 30th Annual Offshore Technology Conference, Houston, Texas, May 4–7, 1998, vol. 1, pp. 505–519.

Da Costa, A. M., Amaral, C. S., "Two and Three–Dimensional Modeling of Bucket Foundations for Application in Deep Water Anchoring", Offshore Engineering, Rio de Janeiro, Brazil, Sep. 1997, pp. 445–456.

Watson, P. G., Randolph, M. F., "A Yield Envelope Design Approach for Caisson Foundations in Calcareous Sediments", 8th Behavior of Offshore Structures International Conference, Delft, Netherlands, Jul. 7–10, 1997, vol. 1, pp. 259–273.

Narasimha Rao, S. et al., "Pullout Behavior of Model Suction Anchors in Soft Marine Clays", 7th International Offshore and Polar Engineering Conference, Honolulu, Hawaii, May 25–30, 1997, pp. 740–744.

Narasimha Rao, S. et al., "Behavior of Suction Anchors in Marine Clays under TLP Loading", OMAE 1997, 16th ASME International Offshore Mechanics and Arctic Engineering Conference, Yokohama, Japan, Apr. 13–17, 1997, vol. 1–B, pp. 151–155.

Datta, M., Kumar, P., "Suction Beneath Cylindrical Anchors in Soft Clay", 6th International Offshore and Polar Engineering Conference, Los Angeles, CA, May 26–31, 1996, vol. 1, pp. 544–548.

Jones, W. C. et al, "Axial Capacity of Suction Piles in Sand", 7th International MA Institute Technology Behavior of Offshore Structures, Cambridge, MA, Jul. 12–15, 1994, pp. 63–75.

Das, B. M., Singh, G., "Uplift Capacity of Plate Anchors in Clay", 4th International Offshore and Polar Engineering Conference, Osaka, Japan, Apr. 10–15, 1994, vol. 1, pp. 436–442.

Larsen, P., "Suction Anchors as an Anchoring System for Floating Offshore Constructions", OTC 6029, 21st Annual Offshore Technology Conference, Houston, TX, May 1–4, 1989, vol. 2, pp. 535–540.

Bogard, D., Matlock, H., "Lateral Pressure Measurements During 2.5 Years of Consolidation and Setup", OTC 8765, 30st Annual Offshore Technology Conference, Houston, TX, May 5–7, 1998, vol. 1, pp. 433–444.

Narasimha Rao, S., Veeresh, C., "Behaviour of Instrumented Model Batter Piles in Clays", 5th International Offshore and Polar Engineering Conference, The Hague, Netherlands, Jun. 11–16, 1995, vol. 1, pp. 511–516.

Trochanis, A. M. et al., "Three–Dimensional Nonlinear Study of Piles", Journal of Geotechnical Engineering, vol. 117, No. 3, Mar. 1991, pp. 429–447.

Nystrom, G. A., Effect of Lateral Soil Movement on Subsequent Axial Pile Capacity: A Finite Strain Analysis, 6th ASME Offshore Mechanics and Arctic Engineering Conference, Houston, TX, Mar. 1–6, 1987, vol. 1, pp. 313–318.

Kagawa, T., "Cyclic and Loading–Rate Effects on Pile Responses", Numerical Methods in Offshore Piling International Conference, Nantes, France, May 21–22, 1986, pp. 417–432.

Briaud, J. L., Terry, T. A., "Rate Effect for Vertical and Horizontal Pile Response", Numerical Methods in Offshore Piling International Conference, Nantes, France, May 21–22, 1986, pp. 387–405.

* cited by examiner

METHOD FOR INSTALLING A PILE ANCHOR

REFERENCE TO RELATED APPLICATION

This application claims the benefit of U.S. Provisional Patent Application No. 60/362,875 filed Mar. 8, 2002.

FIELD OF THE INVENTION

This invention relates generally to pile anchor technology and a method for installing a pile anchor. The technology and deployment methods are particularly suited for installing suction pile anchors as anchoring devices for offshore petroleum structures, such as but not limited to floating structures, drilling or production risers, pipelines and other subsea structures.

BACKGROUND OF THE INVENTION

Suction pile anchors are commonly used in the offshore petroleum industry to moor offshore structures. A suction pile anchor can generally be described as a tubular element, typically but not exclusively circular in cross section, with a closed top and an open bottom. Current practice in the petroleum industry is to install suction pile anchors in a vertical orientation (i.e., the longitudinal axis of the tubular element is installed substantially perpendicularly to the sea floor) at a prescribed distance from the offshore structure it is anchoring. Methods for installing a suction pile anchor in a vertical orientation are known in the industry. In general, after being lowered to the sea floor, the suction pile anchor is allowed to penetrate the soil in a controlled descent, with the weight of the anchor being a primary driving force. Cables are used to help control the descent of the pile anchor, and pressure release mechanisms, such as two-way flow valves on the pile anchor, are opened to allow water to evacuate from inside of the pile anchor, thereby allowing penetration of the pile anchor into the soil. This process is referred to as self-weight penetration. Typically, pile anchors are installed into the seafloor by a combination of self-weight penetration, i.e. the weight of the anchor itself imbeds it into the seafloor, followed by the application of a force on the anchor to obtain the final desired depth of the anchor into the seafloor, i.e. its final penetration. Typically, this force is applied by way of suction penetration. In suction penetration, a water evacuation pump is attached to the suction pile anchor and water pumped out from the anchor's interior. The differential water pressure that is created results in a net downward force that is used to push the suction pile anchor to final penetration. A direct force can also be applied on the anchor, such as using a pile-driving hammer, to achieve final penetration. The direct force can be used either alone or in combination with suction penetration.

Typically, the pile anchor is connected to the offshore structure being moored by an anchor line. This connection is usually accomplished in either a catenary or taut-line application. In a catenary application, the anchor line is usually attached to the suction pile anchor near its top, with the anchor line resting on the sea floor except when tensioned by movement of the structure being moored. In a tautline application, the anchor line is always in tension and it is usually attached to the pile anchor at a location below the sea floor, a distance of some 60% to 70% of the suction pile anchor length, in order to obtain maximum anchor loading capacity. Taut-line suction pile anchor systems have been found to provide maximum resistance for typical deepwater applications where the anchor line assumes an angle with the horizontal equal to about 35 to 45 degrees.

In operation, failure of an anchoring device occurs when it no longer provides resistance against either vertical or horizontal loads, or a combination of both. Of particular concern for pile anchors is preventing vertical load failure. This concern is highlighted during the period after installation when the pile anchor is limited in its ability to resist vertical loads, and therefore the risk of vertical load failure is high. This behavior can be attributed mainly to installation induced disturbance (loss of soil shear strength) in a relatively thin zone of soil that surrounds the pile anchor. Analyses and experience show that the pile anchor can take several months after installation for the soil to regain essentially all of its strength. The lateral resistance is mostly unaffected by the thin zone of disturbed soil, because it mobilizes its resistance from the surrounding undisturbed soil. Accordingly, there is a need in the industry for an installation method that will reduce the risk of vertical load failure of a pile anchor.

When a pile anchor is installed in a traditional vertical orientation, the holding capacity of the anchor will typically increase with the size of the anchor. However, increasing the size of the anchor will cause a corresponding increase in material, fabrication and installation costs. Accordingly, there is a need in the industry for a method of installing a pile anchor that will allow the pile anchor to maintain the same holding capacity at a reduced anchor size. A pile anchor of reduced dimensions can also provide the added benefit of being installed to deeper penetrations, where the soils are typically stronger, and where even greater holding capacity can be achieved.

Correspondingly, there is a need in the industry to increase the holding capacity of a pile anchor of a given dimension in order to reduce the total number of pile anchors required to moor a floating structure. Decreasing the number of pile anchors reduces the installation time, which is a significant cost component of offshore construction.

Accordingly, there is a need for a method of installing a pile anchor that will reduce the risk of vertical failure and increase holding capacity of a pile anchor, and a corresponding need for an installation method that reduces the size and costs of the pile anchor. The present invention satisfies these needs.

SUMMARY OF THE INVENTION

The invention is a method for installing a pile anchor into a sea floor. The pile anchor is positioned at an inclined angle with respect to the sea floor, with the top of the anchor inclined in a direction away from the direction of lateral loading, and then inserted at least partially into the seafloor while the angle of inclination is substantially maintained.

Another embodiment of the invention provides a method of producing offshore hydrocarbon resources. The method includes installing a pile anchor into a sea floor. The pile anchor is positioned at an inclined angle with respect to the sea floor, with the top of the anchor inclined in a direction away from the direction of lateral loading, and then inserted at least partially into the seafloor while the angle of inclination is substantially maintained. The method further includes connecting the anchor to an offshore structure that may support at least some equipment used for producing hydrocarbon resources and producing hydrocarbon resources.

DETAILED DESCRIPTION OF THE INVENTION

The present invention will be described in connection with its preferred embodiments. However, to the extent that the following description is specific to a particular embodiment or a particular use of the invention, this is intended to be illustrative only and is not to be construed as limiting the scope of the invention. On the contrary, it is intended to cover all alternatives, modifications, and equivalents that are included within the spirit and scope of the invention, as defined by the appended claims.

Figure 1:
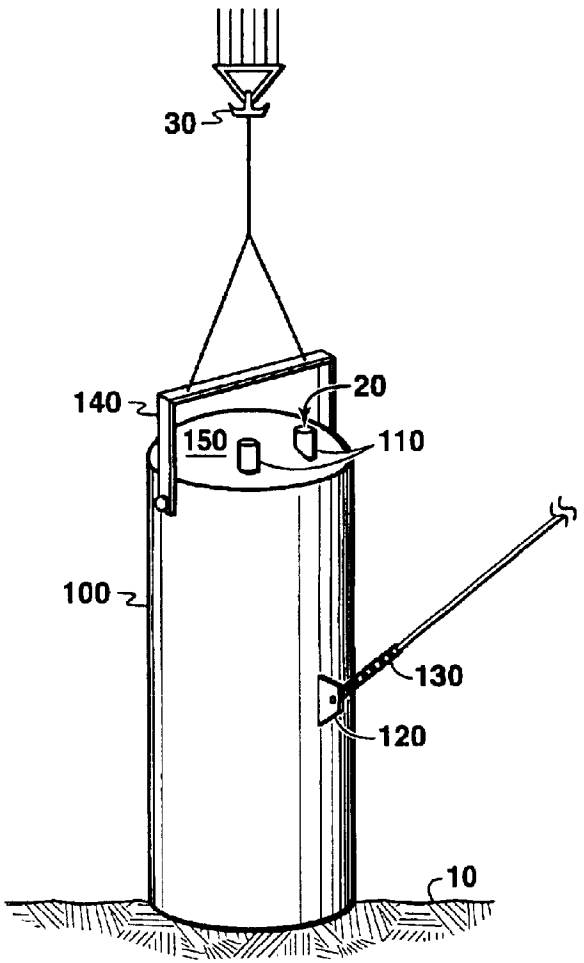
FIG. 1 is a side view of an embodiment of a pile anchor that can be used in accordance with the installation method of this invention.

The present invention is a method for installing a pile anchor into a sea floor, and in particular, the invention permits reducing or eliminating the vertical load acting upon a pile anchor and correspondingly increasing the lateral load component, thereby enhancing the anchor's holding capacity. Referring to FIG. 1, a tubular member, such as the pile anchor (100), embedded in a typical sea floor (10) stratigraphy can achieve a higher holding capacity when it is displaced through the soil perpendicular to its longitudinal axis, as opposed to displacement along its longitudinal axis. These load components represent lateral soil resistance (bearing resistance) and vertical soil resistance (sliding frictional resistance), respectively. The inventive method for deploying the tubular member described herein will permit the pile anchor (100) to be installed so the vertical load component can be reduced incrementally, or completely eliminated.

This invention provides a method for installing a pile anchor into a sea floor at an inclined angle with the top of the anchor tilted away from the offshore structure being moored, i.e. away from the direction of the applied load from the offshore structure. Pile anchors are commonly used in the offshore petroleum industry to moor offshore structures, including but not limited to floating structures, drilling or production risers, pipelines and other subsea structures. A pile anchor is typically a circular cylindrical member having a length to diameter ratio that is typically greater than 2. It can be fabricated in other geometries, however, such as an elliptical cylinder, 3-D rectangle, etc. and can have a smaller length to diameter ratio. An example of a pile anchor is provided in FIG. 1, which shows the pile anchor (100) as a cylindrical body that is closed at the top by a cap (150), and open at its lower end. Padeye (120) is attached to the side of pile anchor (100), and is used as a connection point for anchor chain (130), which transfers the load application from the floating structure (5) being moored. Cap (150) contains two-way flow valves (110). Water evacuation pump (20) can be disengagedly connected to a flow valve (110) for suction installation, as will be discussed later. During the installation process, the pile anchor (100) is supported by deployment hardware such as spreader bar (140), which in turn can be supported by a crane (or other surface machinery) through crane hook (30).

Figure 2A:
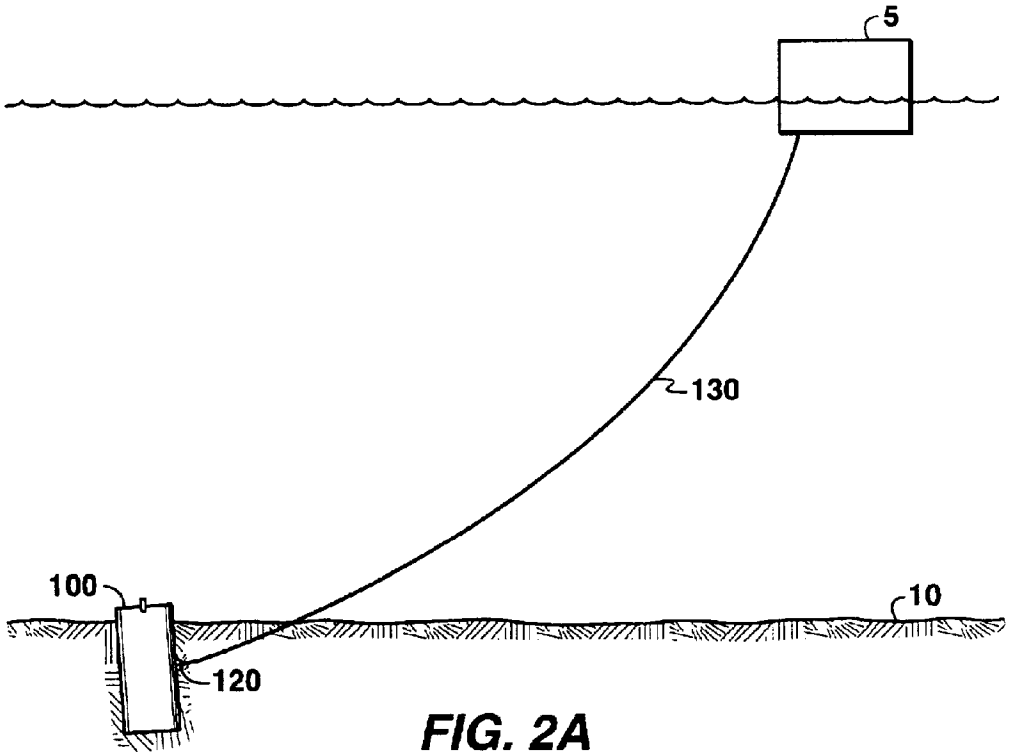
FIG. 2A is a side view of an offshore structure moored by an anchor installed in accordance with the method of this invention.

FIG. 2A provides a side view of an embodiment of the invention where an offshore floating structure (5) is moored by a pile anchor installed in accordance with this invention. Pile anchor (100) is installed in the sea floor (10) at a distance away from the floating structure (5). Anchor chain (130) connects floating structure (5) with pile anchor (100) at padeye (120). Pile anchor (100) is installed at an angle such that the top of anchor (100) is tilted away from floating structure (5). By installing the pile anchor in this manner, the vertical load component acting on the pile anchor (100) is reduced and the lateral component is increased thereby diminishing the risk of anchor failure due to vertical load. This transfer of load from vertical (along the anchor's longitudinal axis) to lateral (perpendicular to the anchor's longitudinal axis) will increase the holding capacity of pile anchor (100). The desired inclination of the pile anchor (100) can be determined by one skilled in the art, with consideration of such factors as the shear strength of the surrounding soil, the anchor line inclination, the anchor line design loads, the deployment vessel, costs, schedule, the method of installation, and other factors. Preferably, but not exclusively, the pile anchor (100) should be installed with an angle so that its longitudinal axis is substantially perpendicular to the applied load.

Figure 2B:
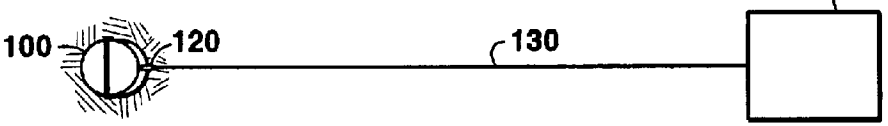
FIG. 2B is a top view of an offshore structure moored by an anchor installed in accordance with the method of this invention.

When installing a pile anchor according to the method of this invention, care should be taken to ensure that minimal torsional forces (rotational forces about the longitudinal axis of the pile anchor) act upon the pile anchor (100) when it is in its final operating position. For example as shown in FIG. 2B, the anchor chain (130) and padeye (120) should be substantially aligned with, i.e., substantially in the same vertical plane as, the floating structure (5). By aligning padeye (120) and anchor chain (130) in the same vertical plane as the floating structure (5), torsional forces acting on the pile anchor (100) caused by the external load are reduced.

Figure 11:
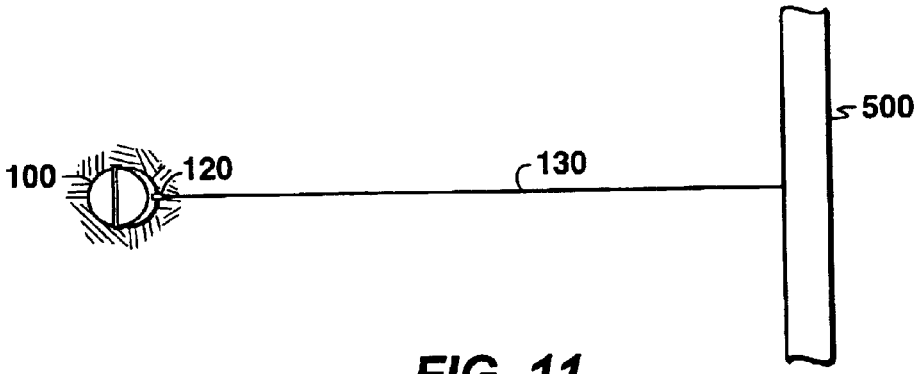
FIG. 11 is a side view of a pipeline moored by an anchor installed in accordance with the method of this invention.
Figure 12:
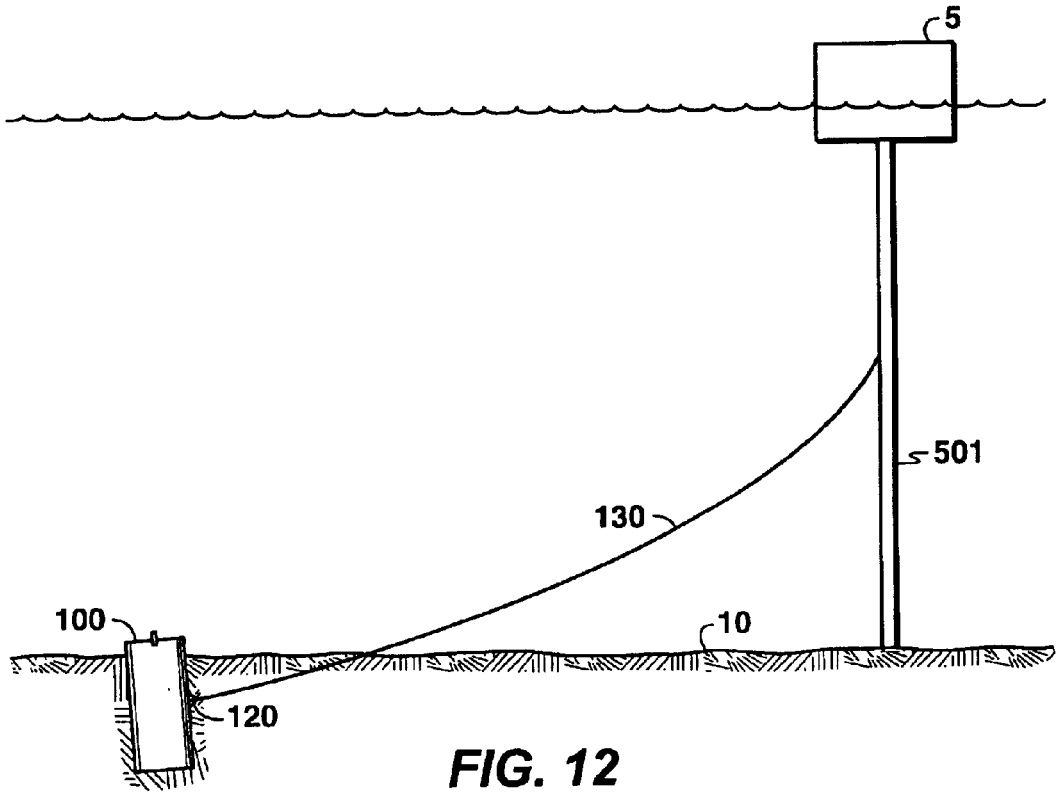
FIG. 12 is a side view of a riser moored by an anchor installed in accordance with the method of this invention.

The method of installation described herein also reduces or essentially eliminates the delay for the pile anchor (100)

to obtain its maximum holding capacity. By installing the pile anchor in accordance with this invention, the pile anchor's resistance with the soil will be mainly lateral soil resistance, i.e. resistance perpendicular to the longitudinal axis of the pile anchor (100), rather than vertical soil resistance, i.e. resistance along the longitudinal axis of the pile anchor (100). Accordingly, the effect of installation induced disturbance of the soil is minimized. Moreover, because the external load acting on the pile (100) is directed laterally through the soil, the capacity of the pile anchor (100) will be greater than a conventionally (vertically) installed pile anchor even if there were no installation induced soil disturbance Several embodiments for installing a pile anchor according to the present invention will now be discussed, with the specific examples of suction pile anchors. It should be recognized that this invention is not limited to methods for installation of suction pile anchors, but any type of pile anchor or other tubular member may be used. This invention is also applicable to pile anchor geometries other than cylinders. Moreover, it should be recognized that an anchor installed in accordance with this invention is capable of mooring floating offshore structures as well as other offshore structures, including but not limited to drilling or production risers (501), pipelines (500) and other subsea structures as depicted, for example, in FIGS. 11 and 12. Those skilled in the art will be able to recognize variations of these embodiments that will be applicable for specific installations.

Figure 3:
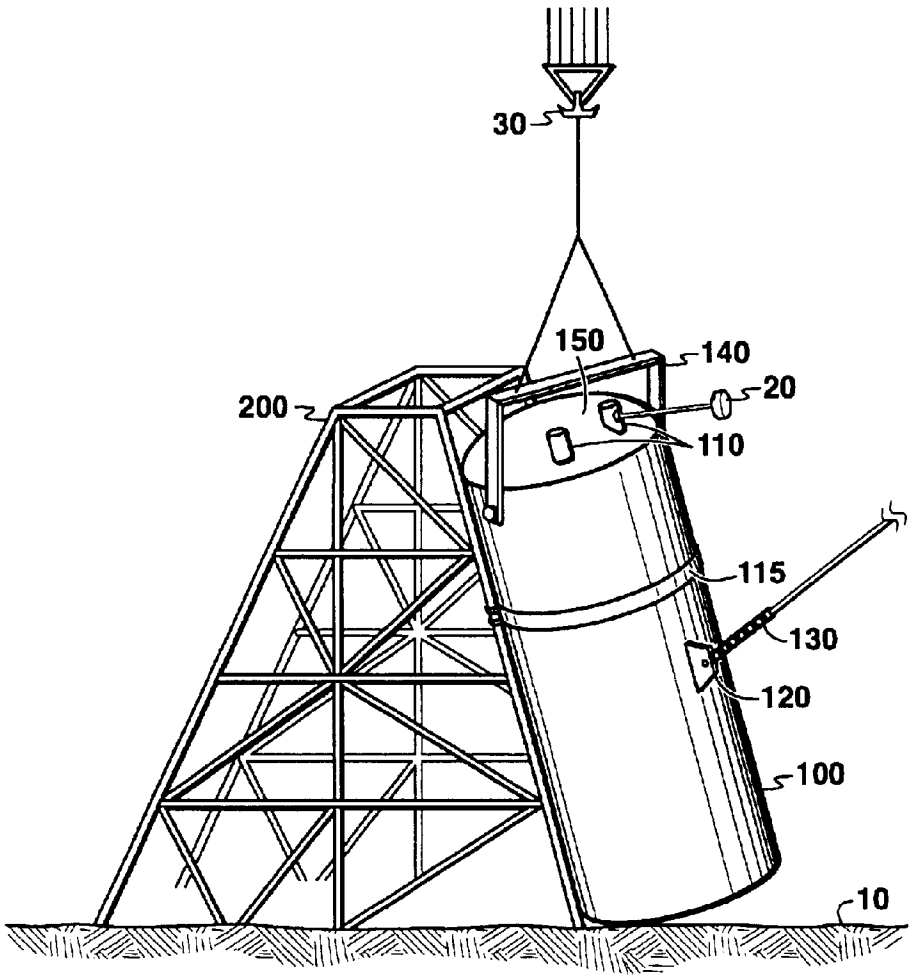
FIG. 3 is a side view of an embodiment of this invention, wherein a guide frame is used to install a pile anchor at an inclined angle into the sea floor.

In one embodiment of the invention, shown in FIG. 3, the suction pile anchor (100) is installed using a guide frame (200) to create and maintain the desired angle of inclination. The installation guide frame (200) is provided on the sea floor (10), typically at a prescribed distance away from the floating structure (5). The suction pile anchor (100) can be preinstalled on the frame (200), or supplied after the guide frame (200) is positioned on the sea floor (10). The guide frame (200) can be provided on the sea floor (10) by typical methods such as using cranes, jacks, or by a remotely operated vehicle (ROV), or the guide frame (200) may be self-propelled and remotely controlled. The installation guide frame (200) can include buoyancy tanks (not shown) to aid in deployment and positioning on the sea floor (10). The installation guide frame (200) preferably has a latching mechanism (115) for the purpose of supporting, securing, and deploying the suction pile anchor (100). Once the guide frame (200) is in position on the sea floor (10), the latching mechanism (115) on the installation guide frame (200) is deactivated and the suction pile anchor (100) can begin self-weight penetration into the sea floor (10). If necessary, final penetration can be achieved by applying direct force on the pile anchor (100), such as with a pile driver or other installation device, or by suction. Suction installation can be achieved by engaging a water evacuation pump (20) to a two-way flow valve (110) on pile anchor (100) and pumping-out the water from inside the suction pile anchor (100), thereby allowing the differential water pressure to push the suction pile anchor (100) to final penetration. The soil provides a natural seal around the lower portion of the suction pile anchor to prevent any significant inflow of water during pumping. Experience indicates that the inclination angle the suction pile anchor (100) achieves after self-weight penetration is not appreciably altered by suction penetration.

Once installation of the pile anchor is complete, another suction anchor (100) can be latched into the installation guide frame (200), and the installation process repeated. Latching the pile anchor (100) to the guide frame (200) may be performed by retrieving the guide frame (200) to a surface vessel (not shown), or while the guide frame (200) rests on the sea floor (10). This installation process can be repeated as necessary.

Figure 4:
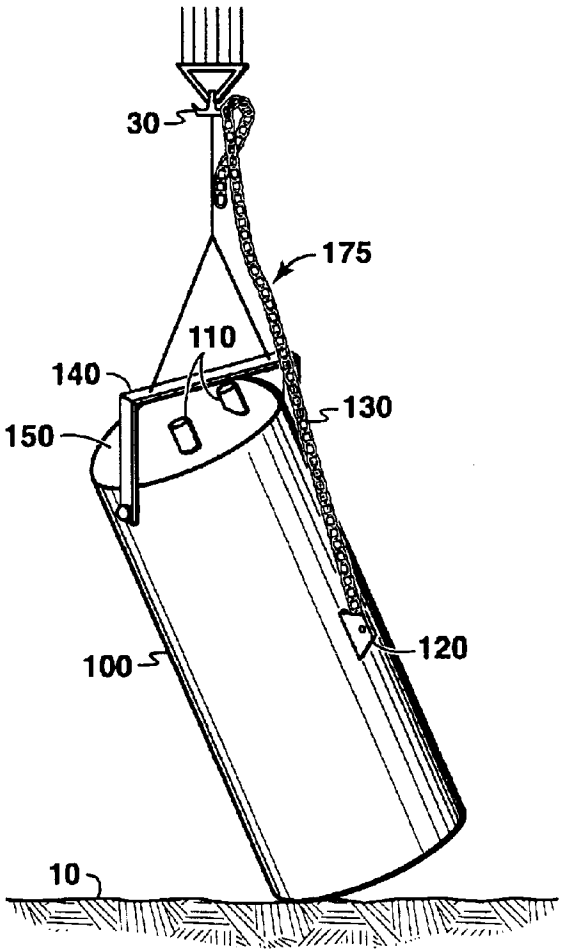
FIG. 4 is a side view of an embodiment of this invention, wherein a tensioning device is used to install a pile anchor at an inclined angle into the sea floor.

In another embodiment of the invention, the desired angle of inclination is created and maintained by connecting a tensioning device (175) to provide upward tension to the side of the pile anchor (100) on which the lateral load connection is applied, i.e. padeye (120). For example, as shown in FIG. 4, anchor chain (130) may serve as the tensioning device (175) for this embodiment. Anchor chain (130) is attached at one end to padeye (120) and is supported on its other end by crane hook (30). The length of tensioning device (175), here the anchor chain (130), can be provided and/or adjusted such that the suction pile anchor (100) is at the desired angle of inclination. Alternative tensioning devices can be used, which include but are not limited to a lifting cable, or bar (or other rigid member). The tensioning device (175) can be supported at its other end by a crane hook (30), as shown in FIG. 4, but can also be connected to another convenient supporting point(s) as long as it provides adequate support for the weight caused by tensioning the anchor (100), such as, but not limited to the spreader bar (140) or a second crane hook. Jacking devices or other appropriate devices may be used instead of cranes for supporting the suction pile anchor (100). Complete installation of the suction pile anchor (100) into the sea floor can be achieved by self-weight penetration, direct force application or suction penetration, or combinations thereof.

Figure 5:
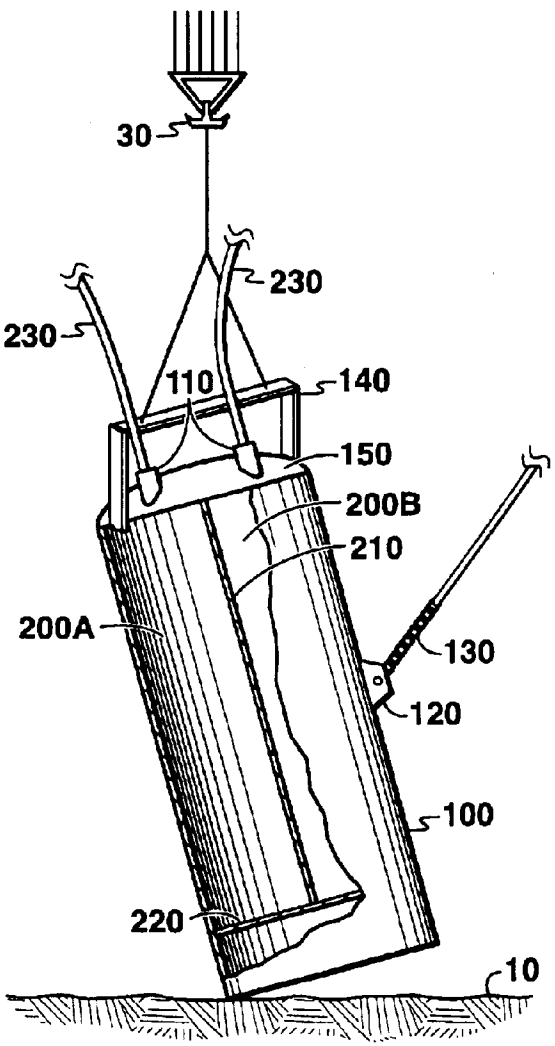
FIG. 5 is a side view of an embodiment of this invention, wherein the pile anchor contains compartments so that the buoyancy of the pile anchor can be adjusted to provide for installation of the pile anchor at an inclined angle into the sea floor.

Referring now to FIG. 5, another embodiment of this invention provides a pile anchor (100) with internal compartments (200A, 200B) that can be selectively evacuated of water to provide selective buoyancy for the pile anchor (100). By selectively adjusting the buoyancy of the pile anchor (100), the desired angle of inclination can be achieved during installation.

The pile anchor (100) for this embodiment contains one or more internal structural member(s) (210), that form two or more internal compartments (200A, 200B) within the pile anchor (100). The internal structural members can be, but are not necessarily made of the same material as the pile anchor (100) itself. Two-way flow valves (110) are fluidly connected to each internal compartment (200A, 200B) through cap (150), and can be used to evacuate water from the individual compartments (200), using a water evacuation pump (not shown). In accordance with this embodiment of the invention, an impermeable membrane (220) is positioned within the lower portion of anchor (100) to prevent inflow of seawater. Gas lines (230) can be fluidly connected to each internal compartment (200A, 200B) being evacuated of water to provide air or other gases to the evacuated compartment(s) to prevent premature rupture of the membrane (220).

The compartments (200A, 200B) can be designed and arranged so that the selective evacuation of water from one or more of the compartments (200A, 200B) will allow for controlled changes to the anchor's (100) buoyancy. For example, referring again to FIG. 5, evacuation of water from individual compartment (200B) (the compartment nearest the load connection point, i.e. padeye (120)) through two-way flow valve (110) will provide buoyancy to compartment (200B), thereby causing the pile anchor (100) to rotate about the spreader bar axis (140). The angle of inclination created by the change in buoyancy to internal compartment (200B) can be varied by the amount of water removed through the two-way flow valve (110). If greater precision in controlling the buoyancy and degree of incline is needed or desired, the pile anchor (100) can be designed with additional internal structural members (210) to provide additional internal compartments (200), each of which can contain a corresponding two-way flow valve (110) (which can be connected to evacuation pump 20) so that water can be selectively removed from the corresponding compartment (200), and buoyancy selectively adjusted.

To install the pile anchor (100) in accordance with this embodiment, the anchor is lowered into the sea, and the internal compartments (200A, 200B) are allowed to fill with water through two-way flow valves (110). The suction pile anchor (100) can be lowered until it is within a few feet of the sea floor (10). Water is pumped out of internal compartment (200B), i.e. the compartment adjacent to the side of the pile anchor (100) on which the lateral load is to be applied, through the corresponding two-way flow valve (110). Air or another gas or gases can be provided through gas line (230) to the internal compartment being evacuated (200B). These selective changes to the anchor's buoyancy causes the suction pile anchor (100) to rotate about the axis of spreader bar (140), with the top of the anchor (100) moving in a direction away from the direction of the lateral load. Pumping is stopped when the desired pile anchor (100) inclination is achieved. The pile anchor (100) is then allowed to penetrate the sea floor (10) by self-weight penetration. Prior to self-penetration, slings or rigging cables (not shown) may be attached to stabilize the suction pile anchor (100) during initial self-weight penetration. During self-weight penetration, the impermeable membrane (220) will rupture automatically or be mechanically removed as the pile anchor (100) penetrates the sea floor (10). The impermeable membrane (220) should be positioned within the pile anchor (100) such that it will rupture only after the soil has formed a seal at the lower end of the anchor (100) to prevent inflow of water. If necessary, final installation can be achieved by direct force, suction penetration or a combination thereof, as previously described.

Figure 6:
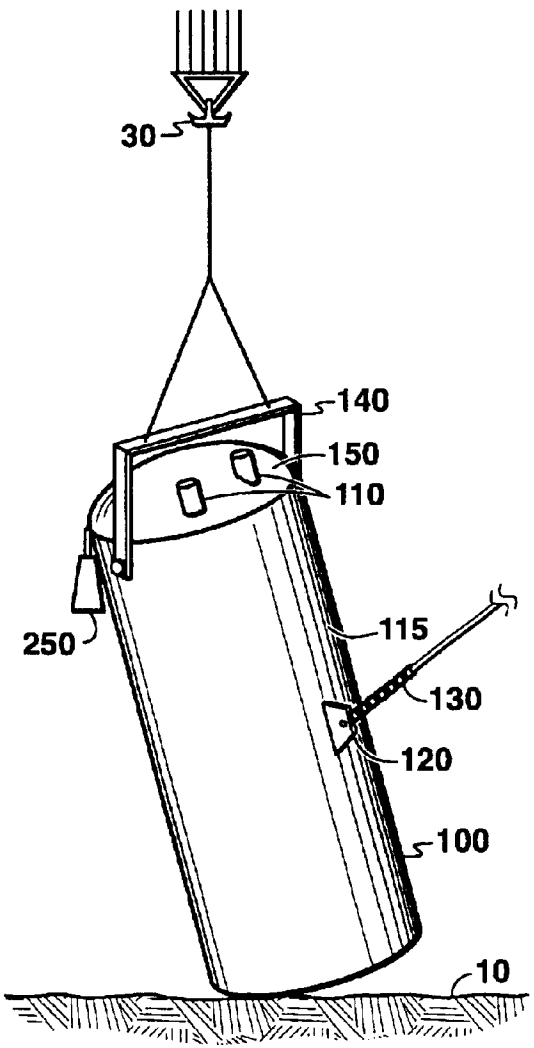
FIG. 6 is a side view of an embodiment of this invention, wherein a weight is used to install a pile anchor at an inclined angle into the sea floor.

Other similar methods for installing a pile anchor (100) at an inclination can be used. Referring to FIG. 6, a weight or load (250) can be attached on the side of the anchor (100) opposite from the direction of the load application. This weight (250) needs to be of a sufficient load to cause the pile anchor (100) to rotate about the axis of spreader bar (140) to the desired angle of inclination. The weight (250) may be attached to the pile anchor (100) at the time of its initial deployment into the water, or later, but should be attached before installation of the pile anchor (100) into the sea floor (10).

Figure 7:
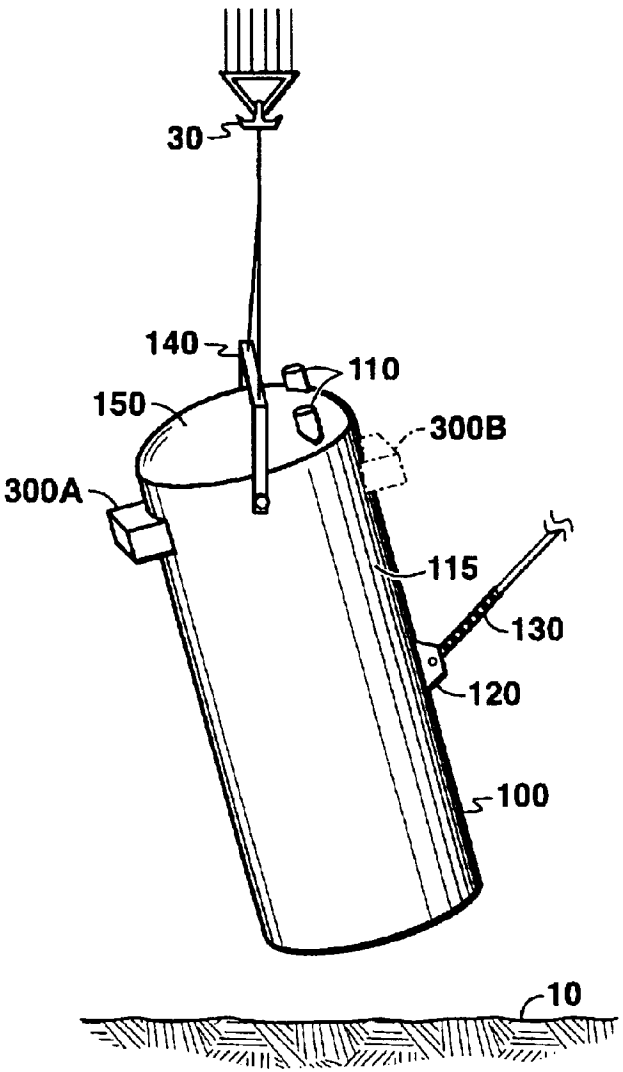
FIG. 7 is a side view of an embodiment of this invention, wherein ballast tanks are provided on the pile anchor, and the technique of removing tanks is used to provide the desired angle of inclination.

Another similar embodiment, shown in FIG. 7, provides a plurality of detachable ballast tanks, for example (300A) and (300B), on or within the anchor (100). The technique of adding and removing ballast tanks, in this example removal of ballast tank (300B), may be used to create the desired angle of inclination.

Figure 8:
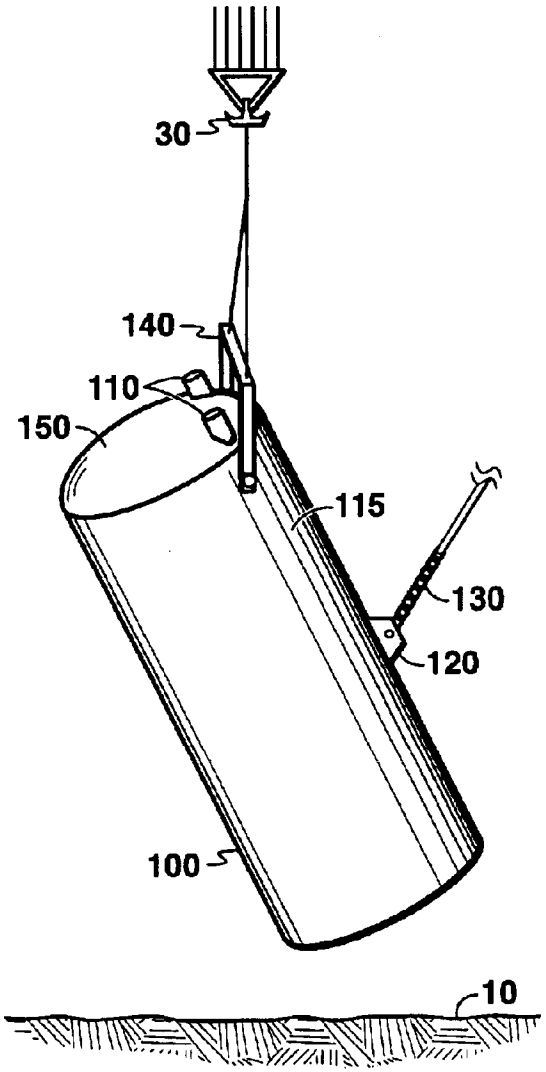
FIG. 8 is a side view of an embodiment of this invention, wherein the desired angle of inclination is obtained by attaching the deployment hardware, indicated in this example by the spreader bar, to the pile anchor at a position offset from the anchor's center of gravity.

Another embodiment is shown in FIG. 8, where the spreader bar (140) or other deployment hardware is attached to the pile anchor (100) at an offset position so that the axis of rotation is not through the center of gravity of the pile (100). The spreader bar (140) or other deployment hardware is positioned such that the suction pile anchor (100) naturally assumes the desired angle of inclination when it is deployed. Rigging cables or slings (not shown) may be employed in these embodiments to steady the suction pile anchor (100) during lowering and initial insertion into the sea floor (10).

Figure 10:
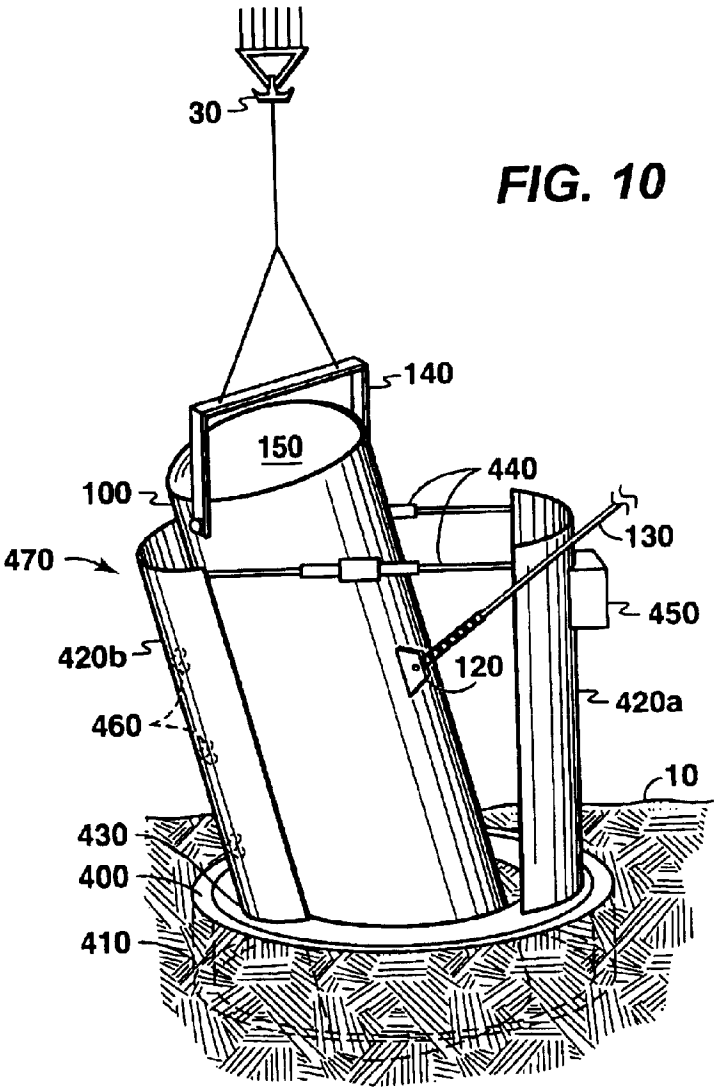
FIG. 10 is a side view of the embodiment of FIG. 9 after initial pile anchor installation, with a frame section having been declined to achieve the desired angle of inclination.
Figure 9:
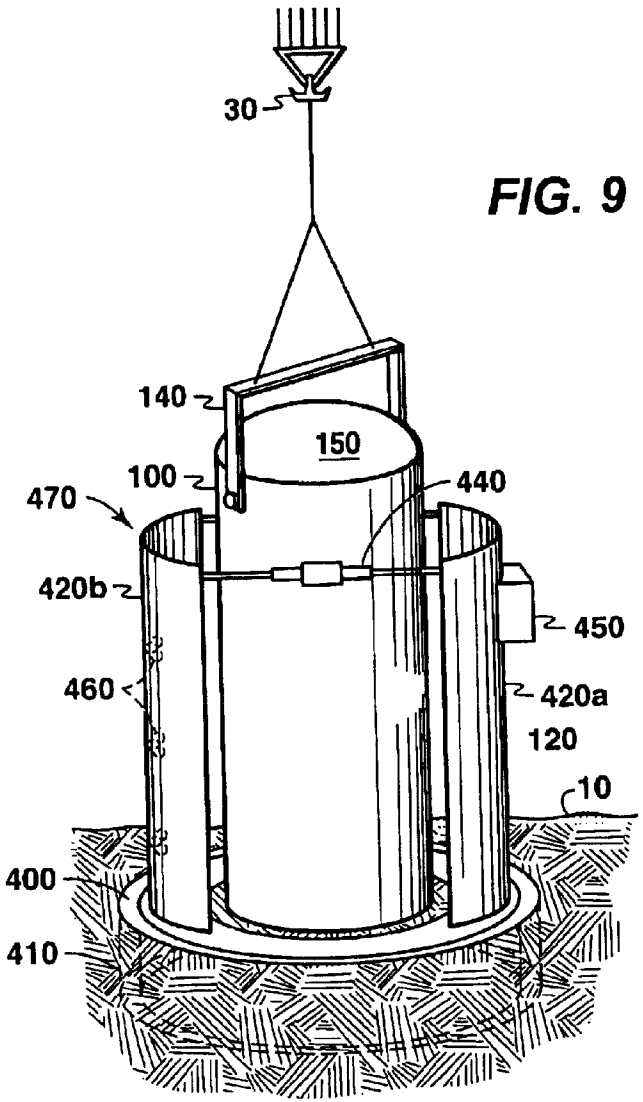
FIG. 9 is a side view of an embodiment of this invention before pile anchor installation, wherein the desired angle of inclination is obtained through use of a mechanical installation frame mechanism.

Another embodiment of the invention is shown in FIGS. 9 and 10. FIG. 9 depicts the installation system before the pile anchor (100) installation while FIG. 10 depicts the installation system after initial pile anchor (100) installation. In this embodiment the desired angel of inclination for the pile anchor (100) is achieved through use of a mechanical installation frame mechanism (470) that is set on top of mat (400) and skirt foundation (410). The skirt foundation (410) is installed into the sea bed (10) to a depth where the mat (400) remains on the surface of the sea bed (10). Pile anchor (100) is contained within frame sections (420A & 420B) that are connected to the mat (400) and/or upper portion of the skirt foundation (410) through a hinge joint (430). The two frame sections (420A & 420B) are movably connected together at each of their upper corners through use of movable jacking devices (440). The jacking devices (440) may be expanded or contracted thereby increasing or decreasing the area between the upper ends of the frame sections (420A & 420B). A buoyancy tank (450) is attached to at least one frame section (420A) to provide a resisting force and moment when the pile anchor (100) is rotated into its inclined position. The buoyancy tank (450) works in conjunction with the skirt (410). At least one of the frame sections (420B) is equipped with rollers (460) on the internal side of such frame section (420B) to enable the pile anchor (100) to slide against such frame section (420B).

The pile anchor (100) is initially contained within the mechanical installation mechanism (470) as depicted in FIG. 9. The pile anchor (100) and mechanical installation mechanism (470) may be lowered to the sea bed (10) separately or together with the pile anchor (100) contained within the structure of the mechanical installation mechanism (470). The skirt foundation (410) is imbedded into the sea bed (10) with the frame sections (420A & 420B) situated approximately perpendicular to the sea bed (10) while the jacking devices (440) are in the retracted position as depicted in FIG. 9. The jacking devices (440) can then be expanded hydraulically or by using an electric motor to push the upper ends of the frame sections (420A & 420B) apart thereby decreasing the angle between at least one of the frame sections (420B) and the sea bed (10) as depicted in FIG. 10. The mechanism used to expand the frame sections (420A & 420B) of the mechanical installation mechanism (470) can be activated by a ROV or acoustically from the water's surface. The pile anchor (100) will then lean against the declined frame section (420B) and will be able to slide in relation to such frame section (420B) through contact with the rollers (460) attached to the inner side of the frame section (420B). After being positioned in the desired angle, the pile anchor (100) may then be inserted a desired distance into the sea bed (10) through gravity and suction penetration.

The pile anchors may be used to anchor an offshore structure through use of anchor chains connected to such pile anchors. The anchor chains may be connected to the anchor using, for example, a padeye. The offshore structure may be a floating structure such as a spar (e.g. a deep draft caisson vessel ("DDCV") or a truss spar) that is equipped with a deck. The deck can support offshore hydrocarbon resource (i.e. oil and gas) exploration, drilling and production operations. The deck may be use to conduct offshore seismic data collection. Alternatively, the deck can support offshore drilling equipment for oil and/or gas drilling operations. Alternatively, the deck may also support oil and/or gas production equipment for the production of offshore oil and gas hydrocarbon resources. Produced oil and/or gas may then be offloaded from the deck by, for example, pipeline to shore or a transport ship or barge and then moved to shore. The oil and gas may then be refined into usable petroleum products such as, for example, natural gas, liquefied petroleum gas, gasoline, jet fuel, diesel fuel, heating oil or other petroleum products.

The present invention has been described in connection with its preferred embodiments. However, to the extent that the foregoing description is specific to a particular embodiment or a particular use of the invention, this is intended to be illustrative only and is not to be construed as limiting the scope of the invention. On the contrary, it is intended to cover all alternatives, modifications, and equivalents that are included within the spirit and scope of the invention, as defined by the appended claims.

I claim:

1. A method for installing a suction pile anchor into a sea floor, said method comprising:

a) positioning said anchor at an inclined angle with respect to the sea floor, the top of said anchor being inclined in a direction away from the direction of lateral loading; and b) inserting said anchor at least partially into said sea floor, said anchor substantially maintaining said inclined angle.

2. The method of claim 1, wherein said anchor is positioned at said inclined angle with a guide frame.

3. The method of claim 1, wherein said anchor is positioned at said inclined angle by applying an upward tension to the side of said anchor closest to said lateral load.

4. The method of claim 1, wherein said anchor is positioned at said inclined angle by applying a weight to the side of said anchor opposite said lateral load.

5. The method of claim 1, wherein said pile anchor further comprises a plurality of ballast means attached to said anchor, and wherein said positioning step comprises removing at least one of said plurality of ballast means from the side of said anchor closest to said lateral load.

6. The method of claim 1, wherein said pile anchor is subdivided into two or more internal compartments, at least a portion of said two or more internal compartments containing water, and wherein said positioning step comprises selectively evacuating at least a portion of said water from at least one of said internal compartments.

7. The method of claim 1, wherein said positioning step comprises deploying said anchor with deployment hardware, wherein said deployment hardware is attached to said anchor at a position offset from said pile anchor's center of gravity.

8. The method of claim 1, wherein said step of inserting said anchor comprises self-weight penetration.

9. The method of claim 1, wherein said step of inserting said anchor comprises applying a direct force to said anchor.

10. The method of claim 1, wherein said step of inserting said anchor comprises suction penetration.

11. The method of claim 1, wherein said step of inserting said anchor comprises self-weight penetration and suction penetration.

12. The method of claim 1, wherein said step of inserting said anchor comprises self-weight penetration and applying a direct force.

13. The method of claim 1, wherein said step of inserting said anchor comprises self-weight penetration, applying a direct force and suction penetration.

14. The Method of claim 1, further comprising:

c) connecting said anchor to an offshore structure.

15. The method of claim 14, wherein said offshore structure is a floating offshore structure.

16. The method of claim 14, wherein said offshore structure is a riser.

17. The method of claim 14, wherein said offshore structure is a pipeline.

18. The method of claim 1, wherein said anchor is positioned at said inclined angle with at least two frame sections moveably connected together with at least one jacking device.

19. A method of producing offshore hydrocarbon resources, comprising:

a) positioning a suction pile anchor at an inclined angle with respect to the sea floor, the top of said anchor being inclined in a direction away from the direction of lateral loading;

b) inserting said anchor at least partially into said sea floor, said anchor substantially maintaining said inclined angle;

c) connecting said anchor to an offshore structure, said offshore structure supporting at least some equipment used for producing hydrocarbon resources; and d) producing hydrocarbon resources.

20. The method of claim 19, further comprising (e) transporting said produced hydrocarbon resources from said offshore structure to shore.

21. The method of claim 20, wherein said offshore structure is a floating offshore structure.

22. The method of claim 20, wherein said anchor is positioned at said inclined angle with a guide frame.

23. The method of claim 20, wherein said anchor is positioned at said inclined angle by applying an upward tension to the side of said anchor closest to said lateral load.

24. The method of claim 20, wherein said anchor is positioned at said inclined angle with at least two frame sections moveably connected together with at least one jacking device.

25. The method of claim 20, wherein said anchor is positioned at said inclined angle by applying a weight to the side of said anchor opposite said lateral load.

26. The method of claim 20, wherein said pile anchor further comprises a plurality of ballast means attached to said anchor, and wherein said positioning step comprises removing at least one of said plurality of ballast means from the side of said anchor closest to said lateral load.

27. The method of claim 20, wherein said pile anchor is subdivided into two or more internal compartments, at least a portion of said two or more internal compartments containing water, and wherein said positioning step comprises selectively evacuating at least a portion of said water from at least one of said internal compartments.

* * * * *